US011340047B2

(12) United States Patent
Loehken et al.

(10) Patent No.: US 11,340,047 B2
(45) Date of Patent: May 24, 2022

(54) SHAPED CHARGE LINER, SHAPED CHARGE FOR HIGH TEMPERATURE WELLBORE OPERATIONS AND METHOD OF PERFORATING A WELLBORE USING SAME

(71) Applicant: DynaEnergetics Europe GmbH, Troisdorf (DE)

(72) Inventors: Joern Olaf Loehken, Troisdorf (DE); Liam McNelis, Bonn (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 241 days.

(21) Appl. No.: 16/640,372

(22) PCT Filed: Sep. 7, 2018

(86) PCT No.: PCT/EP2018/074219

§ 371 (c)(1),
(2) Date: Feb. 20, 2020

(87) PCT Pub. No.: WO2019/052927

PCT Pub. Date: Mar. 21, 2019

(65) Prior Publication Data

US 2020/0217629 A1 Jul. 9, 2020

Related U.S. Application Data

(60) Provisional application No. 62/558,552, filed on Sep. 14, 2017, provisional application No. 62/594,709, filed on Dec. 5, 2017.

(51) Int. Cl.
*E21B 43/117* (2006.01)
*E21B 43/119* (2006.01)
(Continued)

(52) U.S. Cl.
CPC ..... *F42B 1/032* (2013.01); *E21B 43/117* (2013.01); *E21B 43/119* (2013.01); *F42D 1/08* (2013.01)

(58) Field of Classification Search
CPC .. F42B 1/02; F42B 1/028; F42B 1/032; F42B 1/036; E21B 43/117; E21B 43/119; F42D 1/08
See application file for complete search history.

(56) References Cited

U.S. PATENT DOCUMENTS 2,667,836 A 2/1954 Church et al.
3,077,834 A 2/1963 Caldwell
(Continued)

FOREIGN PATENT DOCUMENTS

AU 741792 B2 12/2001
CA 2196385 A1 7/1998
(Continued)

OTHER PUBLICATIONS

Canadian Intellectual Property Office; Office Action for CA Application No. 3,073,997; dated May 12, 2021; 3 pages.
(Continued)

*Primary Examiner* — Daniel P Stephenson
(74) *Attorney, Agent, or Firm* — Moyles IP, LLC

(57) ABSTRACT

A shaped charge liner having a plurality of metal powders including at least one high purity level metal having a purity level of at least about 99.5%. The metal powders and high purity level metal are compressed to form the shaped charge liner, and the shaped charge liner is for installation in a shaped charge. Once installed in the shaped charge, the shaped charge liner is for being thermally softened so that it has a porosity level of less than about 20 volume % and is able to maintain its mechanical integrity when thermally softened. A shaped charge including such liners is disclosed,
(Continued)

as well as a method of perforating a wellbore using such shaped charge having such liners positioned therein.

19 Claims, 7 Drawing Sheets

(51) Int. Cl.
*F42B 1/032* (2006.01)
*F42D 1/08* (2006.01)

(56) References Cited

U.S. PATENT DOCUMENTS 3,119,178 A 1/1964 Owen et al.
3,235,005 A * 2/1966 Delacour ..... F42B 1/02 166/299
3,255,659 A 6/1966 Venghiattis
3,327,630 A 6/1967 Bell
3,375,108 A 3/1968 Wyman et al.
3,589,453 A 6/1971 Venghiattis
3,675,575 A * 7/1972 Bailey ..... F42B 1/032 102/306
3,777,663 A 12/1973 Brown
4,099,464 A 7/1978 Cross et al.
4,109,576 A 8/1978 Eckels
4,273,047 A 6/1981 Rommer
4,387,773 A 6/1983 McPhee
4,496,008 A 1/1985 Pottier et al.
4,537,132 A 8/1985 Sabranski et al.
4,753,301 A 6/1988 Berry
4,784,061 A 11/1988 Christopher
4,817,531 A 4/1989 Walker et al.
4,881,445 A 11/1989 Hayes
4,885,993 A 12/1989 Hancock et al.
5,070,788 A 12/1991 Carisella et al.
5,088,557 A 2/1992 Rides et al.
5,155,293 A 10/1992 Barton
5,155,296 A 10/1992 Michaluk
5,159,145 A 10/1992 Carisella et al.
5,159,146 A 10/1992 Carisella et al.
5,505,135 A 4/1996 Fritz et al.
5,567,906 A * 10/1996 Reese ..... F42B 1/032 102/307
5,792,977 A 8/1998 Chawla
6,008,281 A * 12/1999 Yang ..... B22F 1/0059 264/109
6,098,707 A 8/2000 Pastusek et al.
6,216,596 B1 4/2001 Wesson
6,336,408 B1 * 1/2002 Parrott ..... E21B 36/001 102/312
6,349,649 B1 2/2002 Jacoby et al.
6,378,438 B1 4/2002 Lussier et al.
6,453,817 B1 9/2002 Markel et al.
6,520,258 B1 2/2003 Yang et al.
6,619,176 B2 9/2003 Renfro et al.
6,668,726 B2 12/2003 Lussier
6,684,791 B1 2/2004 Barnhart
6,925,924 B2 8/2005 Baker et al.
7,011,027 B2 3/2006 Reese et al.
7,044,225 B2 5/2006 Haney et al.
7,237,486 B2 7/2007 Myers, Jr. et al.
7,347,279 B2 3/2008 Li et al.
7,522,103 B2 4/2009 Wood
7,658,148 B2 2/2010 Langan et al.
7,690,306 B1 4/2010 King
7,721,649 B2 5/2010 Hetz et al.
7,762,351 B2 7/2010 Vidal
7,775,279 B2 8/2010 Marya et al.
7,849,919 B2 12/2010 Wood et al.
7,987,911 B2 8/2011 Rhodes et al.
8,075,715 B2 * 12/2011 Ashcroft ..... C06B 45/04 149/2
8,156,871 B2 * 4/2012 Behrmann ..... F42B 1/028 102/476
8,220,394 B2 7/2012 Bates et al.
8,322,284 B2 12/2012 Meddes et al.
8,336,437 B2 12/2012 Barlow et al.
8,342,094 B2 1/2013 Marya et al.
8,418,622 B1 4/2013 Pham et al.
8,544,563 B2 * 10/2013 Bourne ..... F42B 1/032 175/4.6
8,561,683 B2 10/2013 Wood et al.
8,794,153 B2 8/2014 Glenn
8,807,003 B2 8/2014 Le et al.
9,080,432 B2 11/2015 Yang et al.
9,187,990 B2 11/2015 Xu
9,291,039 B2 3/2016 King et al.
9,347,119 B2 5/2016 Xu
9,360,222 B1 6/2016 Collier
9,612,095 B2 4/2017 Smart et al.
9,671,201 B2 6/2017 Marya et al.
9,695,677 B2 7/2017 Moody-Stuart et al.
9,862,027 B1 1/2018 Loehken
10,184,327 B2 1/2019 Skyler
10,240,441 B2 3/2019 Geerts et al.
10,267,127 B2 4/2019 Geerts et al.
10,337,301 B2 7/2019 Harive
10,376,955 B2 8/2019 Loehken
10,584,565 B2 3/2020 Golian et al.
10,612,343 B2 4/2020 Hess et al.
10,683,735 B1 6/2020 McCarthy et al.
10,731,443 B2 8/2020 Kaenel et al.
10,739,115 B2 8/2020 Loehken et al.
10,954,760 B2 3/2021 Mcnelis et al.
2001/0052303 A1 12/2001 Mayseless et al.
2002/0017214 A1 2/2002 Jacoby et al.
2002/0189482 A1 12/2002 Kneisl et al.
2005/0115448 A1 6/2005 Pratt et al.
2009/0078144 A1 3/2009 Behrmann et al.
2009/0151949 A1 6/2009 Marya et al.
2010/0300750 A1 12/2010 Hales et al.
2011/0094406 A1 4/2011 Marya et al.
2011/0155013 A1 6/2011 Boyer et al.
2011/0209871 A1 9/2011 Le et al.
2013/0056208 A1 3/2013 Xu
2013/0327571 A1 12/2013 Andrzejak
2013/0340643 A1 12/2013 Yang et al.
2014/0026776 A1 1/2014 Kecskes et al.
2014/0314977 A1 10/2014 Weinhold
2015/0316360 A1 11/2015 Hinton et al.
2015/0361774 A1 12/2015 Flores
2016/0169639 A1 6/2016 Smart et al.
2016/0202027 A1 7/2016 Peterson et al.
2016/0349021 A1 12/2016 Collier et al.
2017/0052004 A1 2/2017 Xue
2017/0058648 A1 3/2017 Geerts et al.
2018/0087353 A1 * 3/2018 Skyler ..... C06B 31/00
2018/0252507 A1 9/2018 Collier
2018/0372460 A1 12/2018 Loehken et al.
2020/0217629 A1 * 7/2020 Loehken ..... E21B 43/119
2020/0256167 A1 8/2020 Gupta et al.
2020/0300067 A1 9/2020 Mcnelis et al.
2021/0164330 A1 6/2021 Mcnelis et al.

FOREIGN PATENT DOCUMENTS

CA 3048505 A1 7/2018
CA 2933762 C 4/2020
CN 105377479 A 3/2016
CN 210598934 U 5/2020
CN 211115936 U 7/2020
CN 111971453 A 11/2020
EP 0538135 B1 5/1997
EP 1345003 A2 9/2003
EP 1317650 B1 5/2006
EP 2282003 A2 2/2011
EP 2598830 A1 6/2013
EP 1682846 B1 1/2014
EP 3144630 B1 1/2020
GB 916870 A 1/1963
GB 2295664 A 6/1996
WO 2001004452 A1 1/2001
WO 2001096807 A2 12/2001

(56) References Cited

FOREIGN PATENT DOCUMENTS

| | | | |
|---|---|---|---|
| WO | 2005035939 | A1 | 4/2005 |
| WO | 2006054081 | A1 | 5/2006 |
| WO | 2008102110 | A1 | 8/2008 |
| WO | 2009117548 | A1 | 9/2009 |
| WO | 2014179689 | A1 | 11/2014 |
| WO | 2016161376 | A1 | 10/2016 |
| WO | 2017029240 | A1 | 2/2017 |
| WO | 2018234013 | A1 | 12/2018 |
| WO | 2019105721 | A1 | 6/2019 |
| WO | 2019238410 | A1 | 12/2019 |
| WO | 2020150232 | A1 | 7/2020 |
| WO | 2021123041 | A1 | 6/2021 |

OTHER PUBLICATIONS

China National Intellectual Property Administration; Office Action for CN Application No. 201880058410.8; dated Sep. 15, 2021; 9 pages.
International Searching Authority, International Search Report and Written Opinion of International App. No. PCT/EP2018/074219, dated Nov. 13, 2018, 17 pages.
Fedorov, Thermal softening of metallic shaped-charge jets formed by the collapse of shaped-charge liners in the presence of a magnetic field, May 2016, Journal of Applied Mechanics and Technical Physics, pp. 483-493, 12 pages.
Dynaenergetics, Unfavorable Trade-Off: High Temperature Explosives vs. Performance Sacrifice, dated May 9, 2016, 19 pages, https://www.perforators.org/wp-content/uploads/2016/05/IPS-16-17.pdf.
HSM Wire International, Inc, Melting Temperatures of common metals and alloys, dated Jul. 9, 2013, 2 pages.
Schatt et al., Pulvermetallurgie: Technologien und Werkstoffe, Edition: 2, 2006, see Temperature tables on p. 444, 2 pages.
Borisenko et al., Hardness of Dispersion-Hardened Copper at Temperatures 290-1070 K, Strength of Materials, vol. 35, No. 4, 2003, 1 page, https://link.springer.com/article/10.1023/A:1025842425119.
Walters et al., Army Research Laboratory, The Particulation of a Shaped Charge Jet for Face-Centered-Cubic Liner Materials, AD-A263297, dated Apr. 1993, 60 pages.
Canadian Intellectual Property Office; Notice of Allowance for CA Application No. 3,073,997; dated Dec. 15, 2021; 1 page.
Canadian Intellectual Property Office; Office Action for CA Application No. 3,067,439; dated Feb. 12, 2021; 3 pages.
Church, et al.; Investigation of a Nickel-Aluminum Reactive Shaped Charge Liner; Journal of Applied Mechanics; vol. 80; dated May 2013; 13 pages.
Church, Philip; Deposition for IPR2016-01850; dated Aug. 17, 2017; 148 pages.
DMC, Boom Times, Winter 2016 Brochure, DynaSlot System Successfully Deployed in a Variety of Applications Around the Globe, Issue 9, Sep. 16, 2016, 3 pgs.
United States Patent and Trademark Office; Non-Final Office Action for U.S. Appl. No. 17/215,159 dated Jul. 26, 2021; 8 pages.
Dynaenergetics, Dynaslot System 360° Certainty Well Abandonment, Produce Brochure, 6 pgs., https://www.dynaenergetics.com/en/products/hardware-and-tcp/perforating-gun-systems/dynaslot-gun-system.
United States Patent and Trademark Office; Requirement for Restriction/Election for U.S. Appl. No. 17/215,159; dated May 24, 2021; 6 pages.
Eakins et al.; Mesoscale simulation of the configuration-dependent shock-compression response of Ni+ Al powder mixtures; Acta Materialia; dated Feb. 4, 2008; 16 pages.
Eakins, et al., Shock compression of reactive powder mixtures; International Materials Reviews; vol. 54, No. 4; pp. 181-213; dated 2009; 33 pages.
European Patent Office Board of Appeals; Decision of Sep. 30, 2021; dated Dec. 7, 2021; 27 pages.
European Patent Office; Decision revoking the European Patent (Art. 101 (3)(b) EPC); dated Nov. 28, 2017; 14 pages.
European Patent Office; Decision revoking the European Patent No. 2598830; dated Nov. 28, 2017; 17 pages.
European Patent Office; Provision of the Minutes in accordance with Rule 124(4) EPC; dated Nov. 28, 2017; 8 pages.
European Patent Office; Summons to Attend Oral Proceedings pursuant to Rule 115(1); dated Mar. 27, 2017 8 pages.
Fischer et al.; A Survey of Combustible Metals, Thermites, and Intermetallics for Pyrotechnic Applications; 32nd AIAA/ASME/ASEE Joint Propulsion Conference; dated Jul. 1-3, 1996; 15 pages.
Global Tungsten and Powders, EnerMetTM Tungsten Powders for the Oil & Gas Industry, Technical Information Bulletin, 2017, 2 pgs., https://www.globaltungsten.com/fileadmin/user_upload/EnerMet_Powders.pdf.
Goodfellow; Aluminium; retrieved from web May 19, 2016; https://www.goodfellow.com/de/de/aluminium; 3 pages.
Goodfellow; Nickel; retrieved from web May 19, 2016; https://www.goodfellow.com/de/de/nickel; 3 pages.
Hardesty, John; Declaration for EP Application No. 16182894.2; dated Aug. 22, 2019; 17 pages.
International Bureau; International Preliminary Report on Patentability for PCT Application #PCT/EP2019/063773; dated Dec. 24, 2020; 11 pages.
International Search Authority, International Search Report and Written Opinion of PCT Application No. PCT/EP2019/063773, dated Aug. 23, 2019, 16 pgs.
International Searching Authority, International Search Report and Written Opinion of International App. No. PCT/EP2018/080831, dated Feb. 15, 2019, 16 pgs.
International Searching Authority, Preliminary Report on Patentability, International App. No. PCT/EP2018/080831, dated Jun. 2, 2020, 9 pgs.
International Searching Authority; International Search Report and Written Opinion of the International Searching Authority for PCT/EP2020/086855; dated Mar. 15, 2021; 14 pages.
Murr, Ballistic and Hypervelocity Impact and Penetration, Metallurgical and Materials Engineering, The University of Texas at El Paso, El Paso, TX, USA, 2014, 54 pgs., https://link.springer.com/referenceworkentry/10.1007%2F978-3-319-01905-5_49-1.
Qinetiq Limited; Article 83 Response; dated Dec. 7, 2018; 92 pages.
Qinetiq Limited; Auxiliary Request in Opposition; dated Oct. 31, 2017; 99 pages.
Qinetiq Limited; QinetiQ Cover Letter stating Main and Auxiliary Requests; dated Sep. 8, 2017; 62 pages.
Qinetiq Limited; Response to Communication under Rule 79(1) EPC; dated Jan. 30, 2017; 12 pages.
Qinetiq Limited; Submission in Appeal Proceedings; dated Nov. 11, 2019; 3 pages.
Qinetiq; Notice of Opposition of EP Patent 3568664; dated Aug. 11, 2021; 7 pages.
Qinetiq; Third Party Observations according to Article 115EPC in relation to European Patent Applications EP17828873.4 and EP17835626.7; dated May 26, 2020; 1 page.
Qinetiq; Third Party Observations according to Article 115EPC in relation to European Patent Applications EP17828873.4 and EP17835626.7; dated Feb. 20, 2020; 3 pages.
Qinetiq; Third Party Observations according to Article 115EPC in relation to European Patent Applications EP17828873.4 and EP17835626.7; dated Aug. 20, 2019; 1 page.
Qinteq Limited; Statement of Grounds of Appeal; dated Mar. 28, 2018; 112 pages.
Schlumberger; Exposed Perforating Gun Systems Through-tubing capsule gun systems; https://www.slb.com/completions/well-completions/perforating/perforating-gun-systems/exposed#related-information; Oct. 26, 2020; 5 pages.
Schlumberger; PowerSprial Nova Extradeep spiral-phased capsule gun perforating system Press Release; dated Oct. 22, 2020; Retrieved from web on Jan. 18, 2021; https://www.slb.com/completions/well-completions/perforating/perforating-guns-and-charges/powerspiral-nova-capsule-gun-perforating-system; 2 pages.

(56) References Cited

OTHER PUBLICATIONS

Thadhani et al.; High-pressure shock activation and mixing of nickel-aluminium powder mixtures; Journal of Materials Science, vol. 28; dated 1993; 12 pages.
U.S. Department of Transporation; Classification of Explosives Fourth Revision; dated Jan. 31, 2014; 52 pages.
United States Patent and Trademark Office, Non-Final Office Action of U.S. Appl. No. 16/760,955, dated Aug. 21, 2020, 14 pages.
United States Patent and Trademark Office, Notice of Allowance for U.S. Appl. No. 16/760,955, dated Dec. 9, 2020, 9 pages.
United States Patent and Trademark Office; Non-Final Office Action for U.S. Appl. No. 16/973,672; dated Oct. 7, 2021; 7 pages.

* cited by examiner

SHAPED CHARGE LINER, SHAPED CHARGE FOR HIGH TEMPERATURE WELLBORE OPERATIONS AND METHOD OF PERFORATING A WELLBORE USING SAME

CROSS-REFERENCE TO RELATED APPLICATIONS

This application claims priority to PCT Application No. PCT/EP2018/074219 filed Sep. 7, 2018, which claims the benefit of U.S. Provisional Application No. 62/558,552 filed Sep. 14, 2017, and U.S. Provisional Application No. 62/594,709 filed Dec. 5, 2017, each of which is incorporated herein by reference in its entirety.

FIELD

A shaped charge liner including a plurality of metal powders having a high purity metal is generally described. More specifically, a shaped charge having a shaped charge liner including at least one high purity level metal having a purity level of at least about 99.5% is described.

BACKGROUND

As part of a well completion process, cased-holes/wellbores are perforated to allow fluid or gas from rock formations (reservoir zones) to flow into the wellbore. Perforating gun string assemblies are conveyed into vertical, deviated or horizontal wellbores, which may include cemented-in casing pipes and other tubulars, by slickline, wireline or tubing conveyance perforating (TCP) mechanisms, and the perforating guns are fired to create openings/perforations in the casings, as well as in surrounding formation zones. Such formation zones may include subterranean oil and gas shale formations, sandstone formations, and/or carbonate formations.

Often, shaped charges are used to form the perforations within the wellbore. These shaped charges serve to focus ballistic energy onto a target, thereby producing a round perforation hole (in the case of conical shaped charges) or a slot-shaped/linear perforation (in the case of slot shaped charges) in, for example, a steel casing pipe or tubing, a cement sheath and/or a surrounding geological formation. In order to make these perforations, shaped charges typically include an explosive/energetic material positioned in a cavity of a housing (i.e., a shaped charge case), with or without a liner positioned therein. It should be recognized that the case, casing or housing of the shaped charge is distinguished from the casing of the wellbore, which is placed in the wellbore after the drilling process and may be cemented in place in order to stabilize the borehole prior to perforating the surrounding formations. Often, the explosive materials positioned in the cavity of the shaped charge case are selected so that they have a high detonation velocity and pressure.

The shaped charges are typically initiated shortly after being placed within the wellbore to prevent prolonged exposure to the high temperature of the wellbore. When initiated, the explosive material housed within the shaped charge detonates and creates a detonation wave, which will generally cause the liner to collapse and be ejected/expelled from the shaped charge, thereby producing a forward moving perforating jet that moves at a high velocity. The perforating jet travels through an open end of the shaped charge case which houses the explosive charge and serves to pierce/penetrate the perforating gun body, casing pipe or tubular and surrounding cement layer to form a cylindrical/conical (perforation) tunnel in the surrounding target geological formation. The tunnel facilitates the flow of and/or the extraction of fluids (oil/gas) from the formation.

Typically, the liners include various constituents, such as powdered metallic and non-metallic materials and/or powdered metal alloys, and binders, selected to generate a high-energy output or jet velocity upon detonation. Imperfections in the liner morphology and/or impurities in the various constituents of the liner have been found to impair the performance of the liner and the resultant perforation tunnel. A general example of such liners 1 is illustrated in FIG. 1. The liner 1 is shown having a generally conical body 2 with an apex portion 3 and a skirt portion 4. The liner 1, after being heated to a temperature up to about 300° C., is illustrated with a plurality of beads or air bubbles 5 formed on the surface of the conical body 2. These beads 5 formed after the liner 1 was heated and are the result of the impurities in the powdered metals used to form the liner 1. It is believed that this diminishes/adversely affects the performance of the liner 1 and results in a perforation jet that is non-uniform or particulates (i.e., separates into different segments) upon detonation of the shaped charge into the wellbore.

In view of the disadvantages associated with currently available methods and devices for wellbore perforating, there is a need for a shaped charge liner that forms a uniform jet upon detonation of a shaped charge. The present disclosure addresses this need, and also provides a shaped charge that does not have to be isolated from the high temperatures of the wellbore, and a method of perforating a wellbore that enhances the resultant flow of fluids from the formation.

BRIEF DESCRIPTION

According to an aspect, the present embodiments may be associated with a shaped charge liner. Such shaped charge liners may create ideal perforation for stimulation of the flow of oil/gas from wellbores.

The shaped charge liner includes a plurality of metal powders. The plurality of metal powders include at least one high purity level metal, which is selected from the group consisting of copper, tungsten, nickel, titanium, aluminum, lead, tantalum and molybdenum. The high purity level metal has a purity level of at least about 99.5%. The metal powders are compressed to form the shaped charge liner. When the shaped charge liner is heated, it has a porosity level of less than about 20 volume %. Such shaped charge liners are able to maintain their mechanical integrity at temperatures of at least about 250° C.

Further embodiments of the disclosure are associated with a shaped charge including a case, an explosive load, and a shaped charge liner. The case includes a closed end, an open end opposite the closed end, and a hollow interior or cavity. The explosive load is disposed in the hollow interior, and the shaped charge liner is disposed on the explosive load. The shaped charge liner may be configured substantially as described hereinabove. The shaped charges including the aforementioned liners may be heated to the temperature of a wellbore so that the shaped charge liner is able to form a rapidly elongating perforation jet, which reduces particulation (i.e., break-up or separation) of the perforating jet upon detonation of the shaped charge into the wellbore.

More specifically, embodiments of the disclosure may further be associated with a method of perforating a wellbore using a shaped charge. The method includes installing at least one shaped charge within a shaped charge carrier. The shaped charge includes a case, an explosive load, and a shaped charge liner, which may be configured substantially as described hereinabove. The shaped charge carrier and the shaped charge installed therein, is thereafter positioned into the wellbore. The shaped charge and the shaped charge liner housed therein is heated, or allowed to be, by the wellbore temperature. According to an aspect, when the shaped charge liner is heated to a temperature of up to about 250° C., the packing density of the particles increases so that the liner has a porosity of less than about 20 volume %. The heated liner is not only able to maintain its mechanical integrity at a temperature of at least about 250° C., but also becomes malleable when heated. In addition, when the shaped charge is detonated, the shaped charge liner is able to form a perforating jet that is coherent and rapidly elongating, which reduces particulation of the perforating jet and enhances stimulation of the flow of oil/gas from wellbore.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
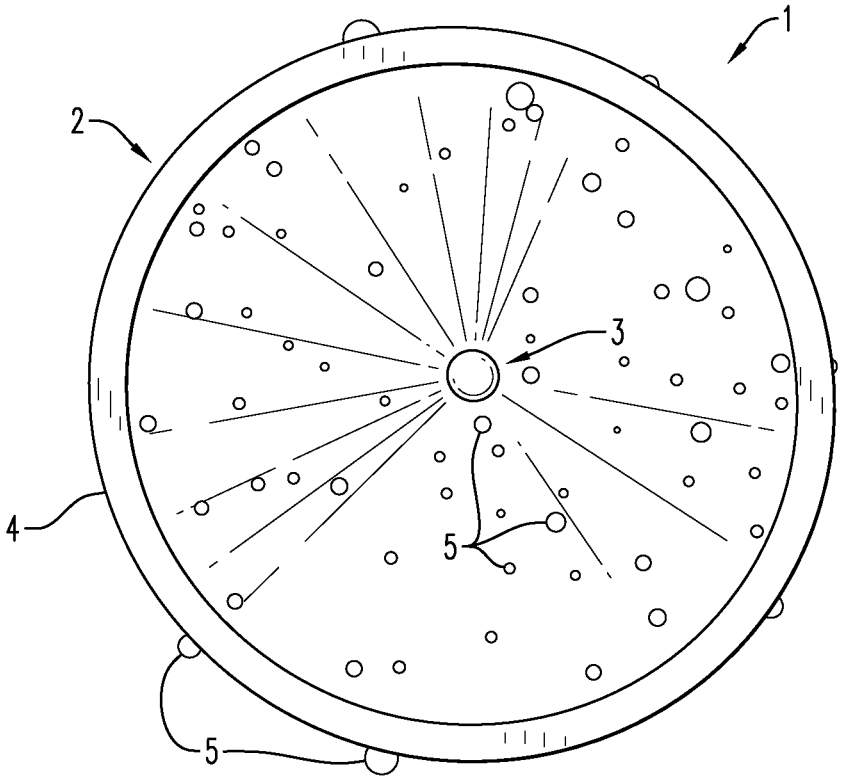
FIG. 1 (PRIOR ART)
FIG. 1 is an illustration of a prior art shaped charge liner with beads on its surface.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

For purpose of illustrating features of the embodiments, embodiments will now be introduced and referenced throughout the disclosure. Those skilled in the art will recognize that these examples are illustrative and not limiting, and are provided for purely explanatory purposes.

Figure 2A:
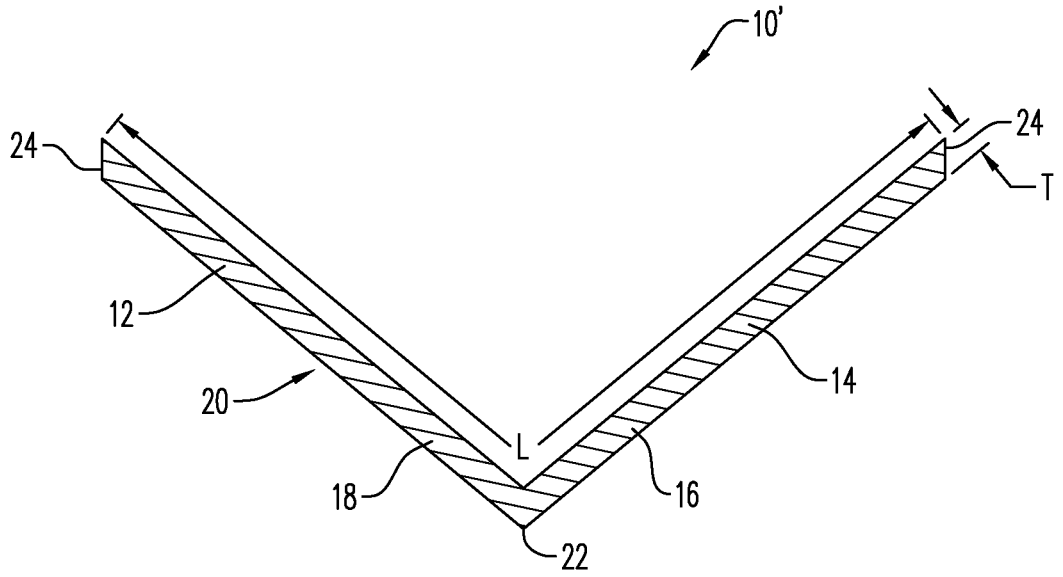
FIG. 2A is a cross-sectional view of a conical shaped charge liner having a plurality of metal powders, according to an embodiment.
Figure 2B:
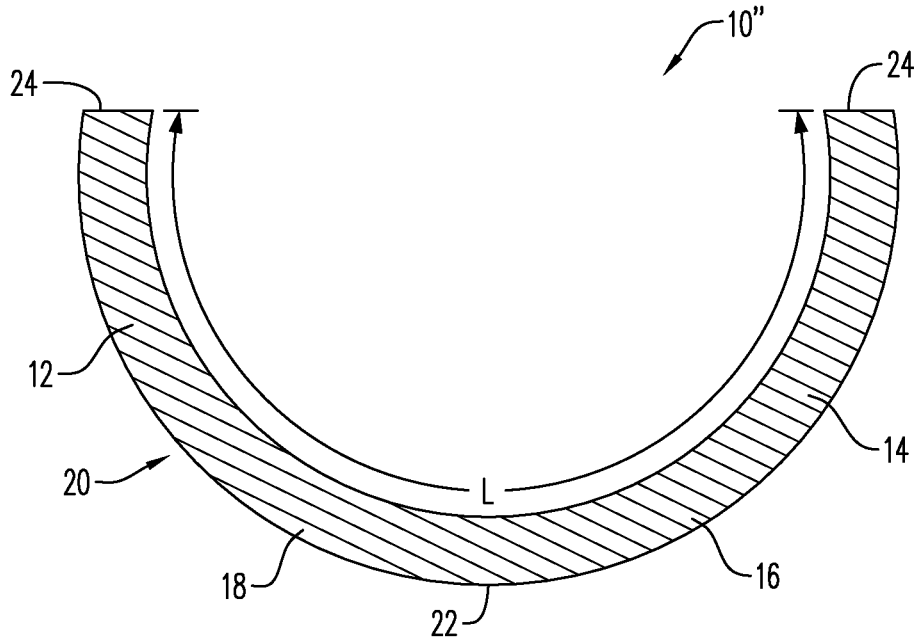
FIG. 2B is a cross-sectional view of a hemispherical shaped charge liner having a plurality of metal powders, according to an embodiment.
Figure 2C:
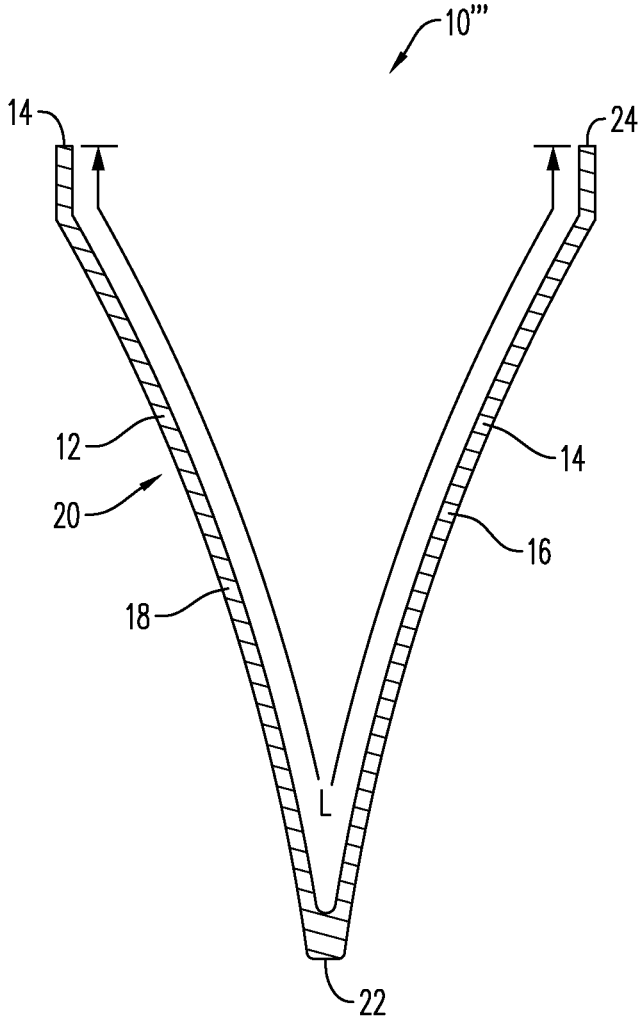
FIG. 2C is a cross-sectional view of a trumpet shaped charge liner having a plurality of metal powders, according to an embodiment.
Figure 3:
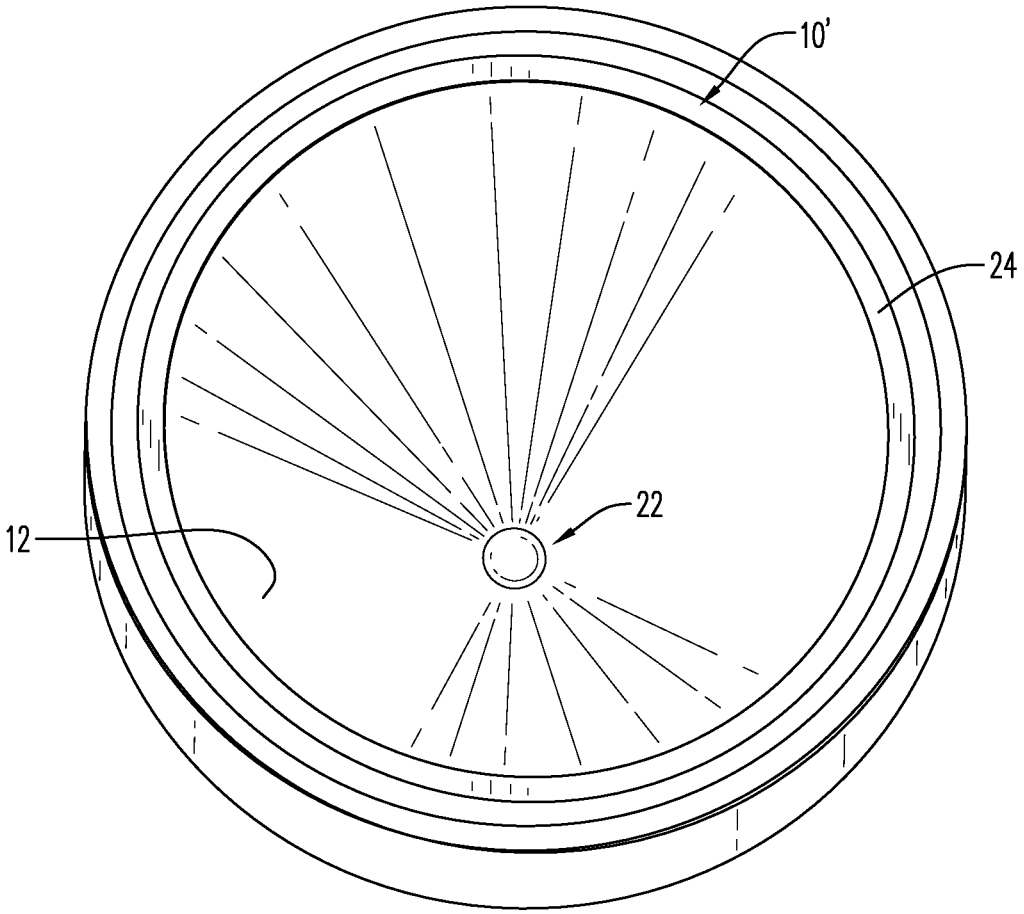
FIG. 3 is a top down, perspective view of a shaped charge liner including at least one high purity metal powder, illustrating the shaped charge liner after being thermally softened, according to an embodiment.
Figure 4:
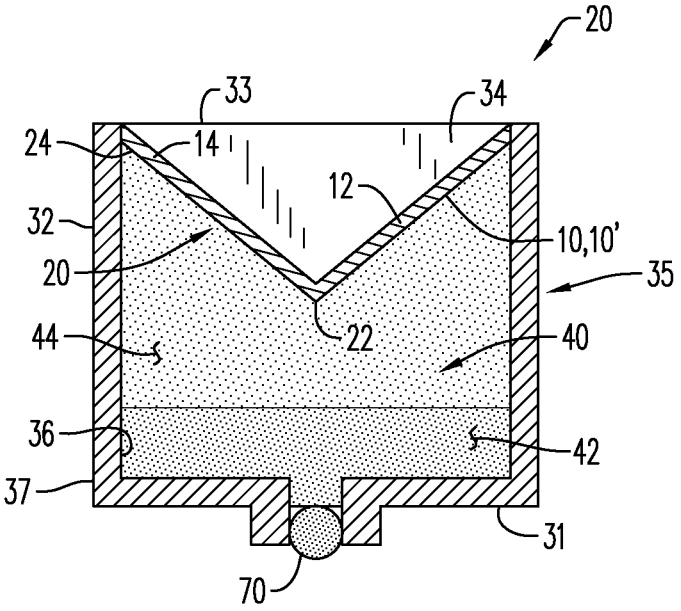
FIG. 4 is a cross-sectional view of a slot shaped charge having a shaped charge liner, according to an embodiment.
Figure 5:
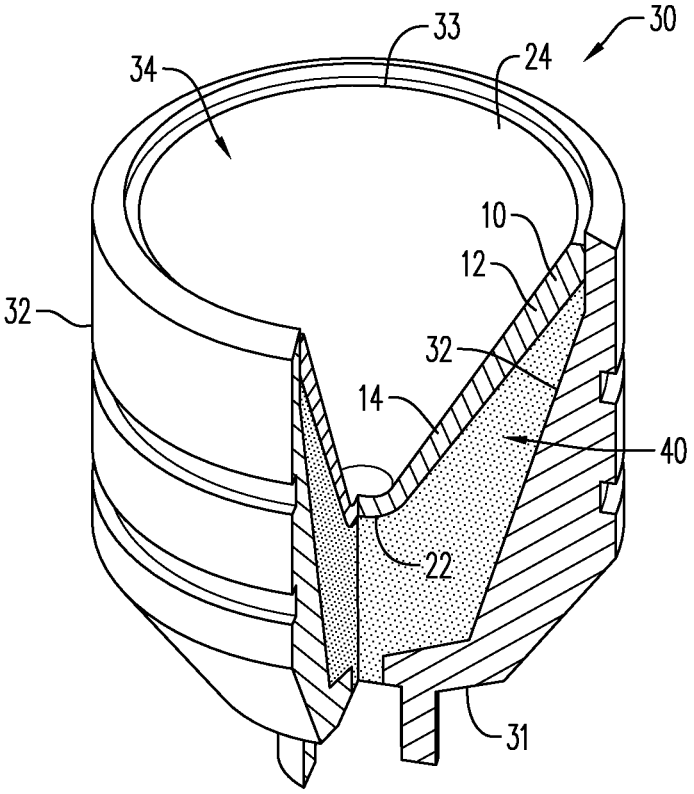
FIG. 5 is a partial cross-sectional, perspective view of a conical shaped charge having a shaped charge liner, according to an embodiment.

In the illustrative examples and as seen in FIGS. 2A-5, a liner 10/10'/10"/10''' (generally "10") for use in a shaped charge 30 is illustrated. As illustrated in FIGS. 4 and 5, the shaped charge 30 may include a case/shell 32 having a wall (or plurality of walls) 35. The walls 35 may be configured so that they form the case 32 of a slotted shaped charge (FIG. 4) or a conical shaped charge (FIG. 5). The plurality of walls 35 together define a hollow interior/cavity 34 within the case 32. The case 32 includes an inner surface 36 and an outer surface 37. An explosive load 40 may be positioned within the hollow interior 34 of the case 32, along at least a portion of the inner surface 36 of the shaped charge case 32. According to an aspect, the liner 10 is disposed adjacent the explosive load 40, so that the explosive load 40 is disposed adjacent the plurality of walls 35 of the case 32. The shaped charge 30 has an open end 33, through which a jet is eventually directed, and a back end (closed end) 31, which is typically in communication with a detonating cord 70 (FIG. 4).

The liner 10 may have a variety of shapes, including conical shaped (e.g., liner 10') as shown in FIG. 2A, hemispherical or bowl-shaped (e.g., liner 10") as shown in FIG. 2B, or trumpet shaped (e.g., liner 10''') as shown in FIG. 2C. To be sure, the liner 10 may have any desired shape, which may include shapes other than those referenced herein.

The shaped charge liner 10 generally has an apex portion 22 and a perimeter that forms a skirted portion 24. The shaped charge liner 10 may generally have a thickness T/T1/T2 (generally "T") ranging from between about 0.5 mm to about 5.0 mm, as measured along its length L. As illustrated in FIGS. 2A and 2B, the thickness T is uniform along the liner length L, that is, along the apex and skirt portions 22, 24. In an alternative embodiment and as illustrated in FIG. 5, the thickness T varies along the liner length L, such as by having a thickness that is larger/greater closer to the walls of the case 32 and a thickness that is decreases or gets thinner closer to the center of the shaped charge 30 (or apex 22 of the liner). Further, in one embodiment, the liner 10 (e.g., liner 10') may extend across the full diameter of the cavity 50 as shown in FIGS. 2A-2C. In an alternative embodiment (not shown), the liner 10'/10"/10''' may extend only partially across the diameter of the cavity 34, such that it does not completely cover the explosive load 40.

Additionally, the composition of the illustrative liners 10, as seen for instance in FIGS. 2A-2C, may be formed as a single layer (as shown). In an alternative embodiment, the liner 10' may have multiple layers (not shown). An example of a multiple-layered liner is disclosed in U.S. Pat. No. 8,156,871, which is hereby incorporated by reference to the extent that it is consistent with the disclosure.

According to an aspect, the shaped charge liner 10 generally includes various powdered/pulverized metallic and/or non-metallic powdered metals, alloys and binders. Such shaped liners are, for instance, described in U.S. Pat. Nos. 3,235,005, 3,675,575, 5,567,906, 8,075,715, 8,220,394, 8,544,563 and German Patent Application Publication No. DE102005059934, each of which is incorporated herein by its entirety.

The shaped charge liner 10 includes a plurality of metal powders 12. The plurality of metal powders 12 is compressed to form the shaped charge liner 10. The metal powders 12 may include lead, copper, aluminum, nickel, tungsten, titanium, molybdenum, aluminum-bronze, manganese-bronze, or any other metal powder or alloys that have a melting temperature of above 320° C., as would be understood by one of ordinary skill in the art.

The plurality of metal powders 12 includes at least one high purity level metal 14 having a purity level of at least about 99.5%. As such, the high purity level metal 14 has less than about 0.5% of any other type of identifiable metal (i.e., metal contaminant) within any given sample.

FIG. 3 illustrates an exemplary shaped charge 30 including a shaped charge liner 10 according to embodiments of the present disclosure. According to an aspect, the shaped charge liner 10 is heated or thermally softened while positioned in a shaped charge 30 that is disposed in a wellbore, so that the shaped charge liner 10 has a porosity of less than about 20 volume %. The shaped charge liner 10 may be heated so it has a porosity of less than about 10%. It is contemplated that the shaped charge liner 10 is thermally softened at a temperature (T) of up to about 250° C., alternatively up to about 190° C., prior to detonation of the shaped charge 30 within which the liner 10 is disposed. As illustrated in FIG. 3, the inclusion of the high purity level metal 14 in the shaped charge liner 10 substantially eliminates or reduces air pockets (i.e., porous beads or bubbles) that can form in typical liners when heated, as illustrated in FIG. 3.

The at least one high purity level metal 14 is present in an amount up to about 95% of a total weight of the plurality of metal powders 12. Various high purity level metals 14 may be compressed to form the liner 10. According to an aspect, the high purity level metal 14 is selected from the group consisting of copper, tungsten, nickel, titanium, aluminum, lead, tantalum and molybdenum. For instance, a copper powder having a hardness of about 77-99 Vickers (HV) (or 2.5 to 3.0 Mohs) and a tensile strength of 350 MPa may be utilized, with or without another high purity level metal 14. Without being bound by theory, it is believed that the hardness of the selected high purity level metal 14 will be reduced when the shaped charge liner 10 is heated. According to an aspect, the hardness of the high purity level metal may be reduced by an amount up to about 20%.

The melting temperatures of the high purity level metal 14 included in the shaped charge liner 10 helps the shaped charge liner 10 (when heated) maintain its mechanical integrity. According to an aspect, the high purity level metal 14 has a melting temperature greater than about 320° C. Alternatively, the high purity level metal 14 has a melting temperature greater than about 600° C., alternatively greater than about 1,050° C., alternatively greater than about 1,600° C., alternatively greater than about 3,000° C. According to an aspect, the heated shaped charge liner 10 maintains its mechanical integrity (i.e., its original shape) even when subjected to a temperature of at least about 250° C.

The plurality of metal powders 12 may include a first high purity level metal and a second high purity level metal. While the first and second high purity level metals may have substantially similar melting temperatures, it is contemplated that the first high purity level metal may have a melting temperature that is greater or less than the melting temperature of the second high purity level metal. For instance, in some embodiments, the first high purity level metal may have a melting temperature between about 320° C. to about 1,200° C., and the second high purity level metal may have a melting temperature between about 1,400° C. to about 3,500° C. In this configuration, the first high purity level metal will begin to soften, and may in some circumstance melt and adhere to the other metals 12 or other high purity level metals 14 in the shaped charge liner 10 at a lower temperature than the second high purity level metal.

According to an aspect, the first high purity level metal may be present in an amount of about 5% w/w to about 40% w/w of a total weight of the plurality of metal powders 12, while the second high purity level metal may be present in an amount of about 60% w/w to about 95% w/w of the total weight of the plurality of metal powders 12. The quantities of the first and second high purity level metals in the total weigh to the composition of metal powders 12 may be selected at least in part based on the ability of each high purity level metal's 14 ability to interact with each other and/or other constituents of the shaped charge liner 10.

The shaped charge liner 10 may include a binder 16. The binder 16 helps to maintain the shape and stability of the liner 10. According to an aspect, the binder 16 includes a high melting point polymer resin having a melting temperature greater than about 250° C. The resin may include a fluoropolymer and/or a rubber. In an embodiment, the high melting point polymer resin is Viton™ fluoroelastomer. The binder 16 may include a powdered soft metal, such as graphite, that is mixed in with the plurality of metal powders 12. In an embodiment, the powdered soft metal is heated (and may be melted) prior to being combined/mixed with the plurality of metal powders 12. This helps to provide for adequate dispersion and coating of the metal powders 12 within the shaped charge liner 10 and reduces or substantially eliminates the amount of dust that may form in the environment, thereby reducing the likelihood of creating a health hazard and reducing potential toxicity levels of the liner 10.

Embodiments of the liners of the present disclosure may be used in a variety of shaped charges 20, 30, which incorporate the above-described shaped charge liners 10. The shaped charges 20, 30 include a case 32 that has a closed end, an open end 33 opposite the closed end 31, and a plurality of walls (or wall) 35 extending between the closed and open ends 31, 33. As noted hereinabove, the shaped charge of FIG. 4 is a slot shaped charge 20, having a closed end 31 that is substantially planar or flat. In contrast, the shaped charge of FIG. 5 is a conical shaped charge having a closed end 31 that has a conical shape. The shaped charges 20, 30 are detonated via a detonation cord 70 that is adjacent an area of their close ends 31 and is in communication with an explosive load 40 positioned within a cavity (hollow interior) 34 of the shaped charge. According to an aspect, the shaped charges 20, 30 may be encapsulated.

FIGS. 4-5 illustrate the hollow interior or cavity 34 having an explosive load 40 is disposed therein. The explosive load may abut the closed end 31 and may extend along an inner surface 36 of the case 32. The explosive load 40 may include at least one of hexanitrostibane (HNS), diamino-3,5-dinitropyrazine-1-oxide (LLM-105), pycrlaminodinitropyridin (PYX), and triaminotrinitrobenzol (TATB). According to an aspect, the explosive load 40 is a mixture of pycrlaminodinitropyridin (PYX) and triaminotrinitrobenzol (TATB). As illustrated in FIG. 4, the explosive load 40 may include a primary explosive load 42 and a secondary explosive load 44. The primary explosive load 42 may be adjacent the closed end 31, while the secondary explosive load 44 is in a covering relationship with the primary explosive load 42. The primary explosive load 42 includes at least one of HNS, LLM-105, PYX, and TATB, while the secondary explosive load 44 includes a binder 16 (described in further detail hereinabove) and at least one of HNS, LLM-105, PYX, and TATB.

A shaped charge liner 10 may be disposed adjacent the explosive load 40 (or secondary explosive load 44), thus retaining the explosive load 40, 44 within the hollow interior 34 of the case 40. The liner 10, while shown in a conical configuration 10' in the shaped charges of FIGS. 4-5, may also be present in a hemispherical configuration 10" as shown in FIG. 2B. To be sure, the liners 10 described hereinabove may be utilized in any shaped charge. The liner 10 may include a plurality of metal powders 12 having at least one high purity level metal 14. Therefore, the shaped charge liners 10 of the present disclosure may serve multiple purposes, such as, to maintain the explosive load 40 in place until detonation and to accentuate the explosive effect on the surrounding geological formation.

For purposes of convenience, and not limitation, the general characteristics of the shaped charge liner 10 are described above with respect to FIGS. 2A-2C and are not repeated here. According to an aspect, the liner 10 of the shaped charge 30 includes the metal powders 12 substantially as described hereinabove. For instance, the metal powders 12 may include at least one high purity level metal 14 having a purity level of at least about 99.5%. The plurality of metal powders 12 and high purity level metal 14 are compressed to form the shaped charge liner 10 and after the shaped charge liner 10 is formed, the shaped charge liner 10 is thermally softened prior to detonation of the shaped charge 30 into a target. When heated, the shaped charge liner 10 has a porosity of less than about 20 volume % and is able to maintain its mechanical integrity at a temperature of at least about 250° C.

The process of allowing heat to be applied to the liners 10 and/or the shaped charges 20, 30 incorporating the liners 10 according to the present disclosure is contrary to the conventional wisdom that shaped charges must be initiated at ambient temperature immediately or soon after or deployment in the wellbore. It has surprisingly been found that the shaped charge liners 10 described herein do not have to be isolated or protected from the increased temperature of the wellbore, because the increase in temperature of the metal powders and high purity metal powders actually enhances the performance of the shaped charge liner 10. By virtue of the conveyance method for the perforating systems and the downhole temperature, the liners 10 are pre-conditioned by the exposure to the wellbore's temperature before the shaped charges are detonated in the wellbore. The liners 10 (within their respective casing and/or positioned in a perforating gun and/or a shaped charge carrier) are pre-conditioned by virtue of the wellbore having a temperature that is greater than an initial temperature of the shaped charge at the ground surface. The preheating treatment of the liner 10 changes the morphology of the liner 10 itself so that an enhanced collapse process of the shaped charge liner and an improved perforating jet performance will occur. When the liners 10 are heated in the wellbore, the metals 12, 14 soften, which helps to further bind the metals together. The temperature at which the liner is heated, and the length of the heat treatment, may be customized according to the types of powdered metals in the liners 10.

Figure 6:
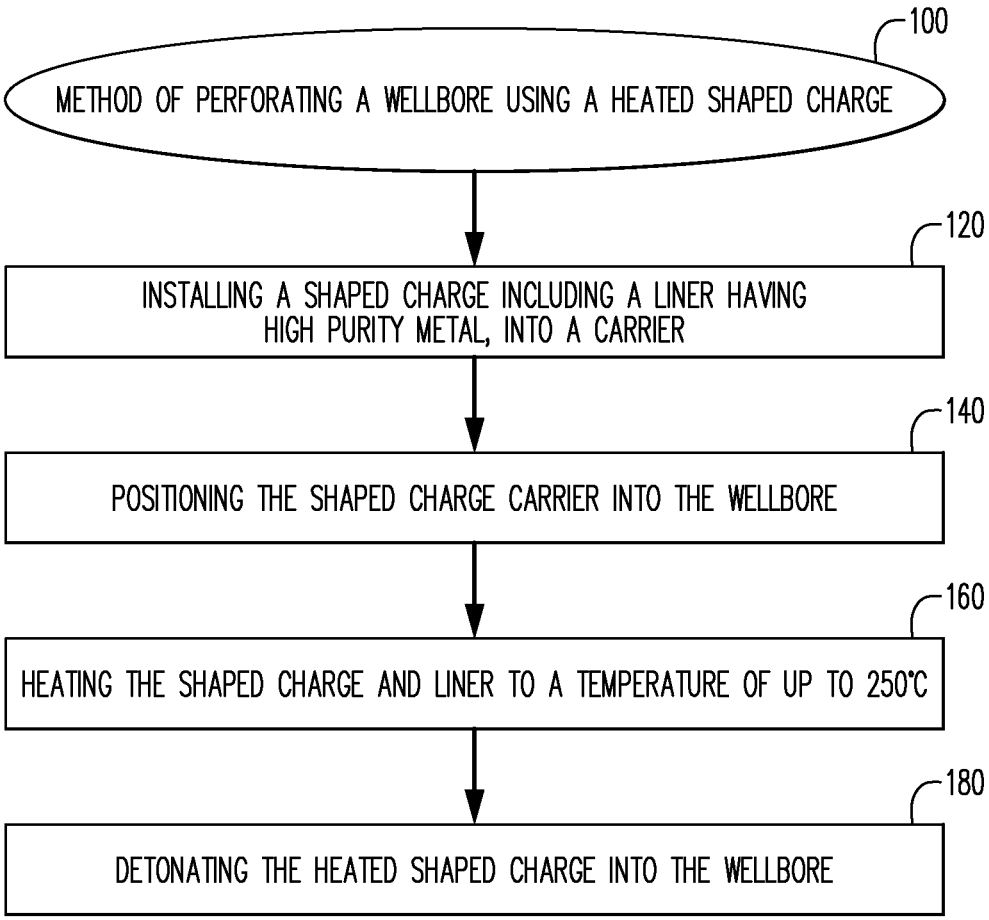
FIG. 6 is a flow chart illustrating a method of perforating a wellbore using a heated shaped charge, according to an embodiment.
Figure 7:
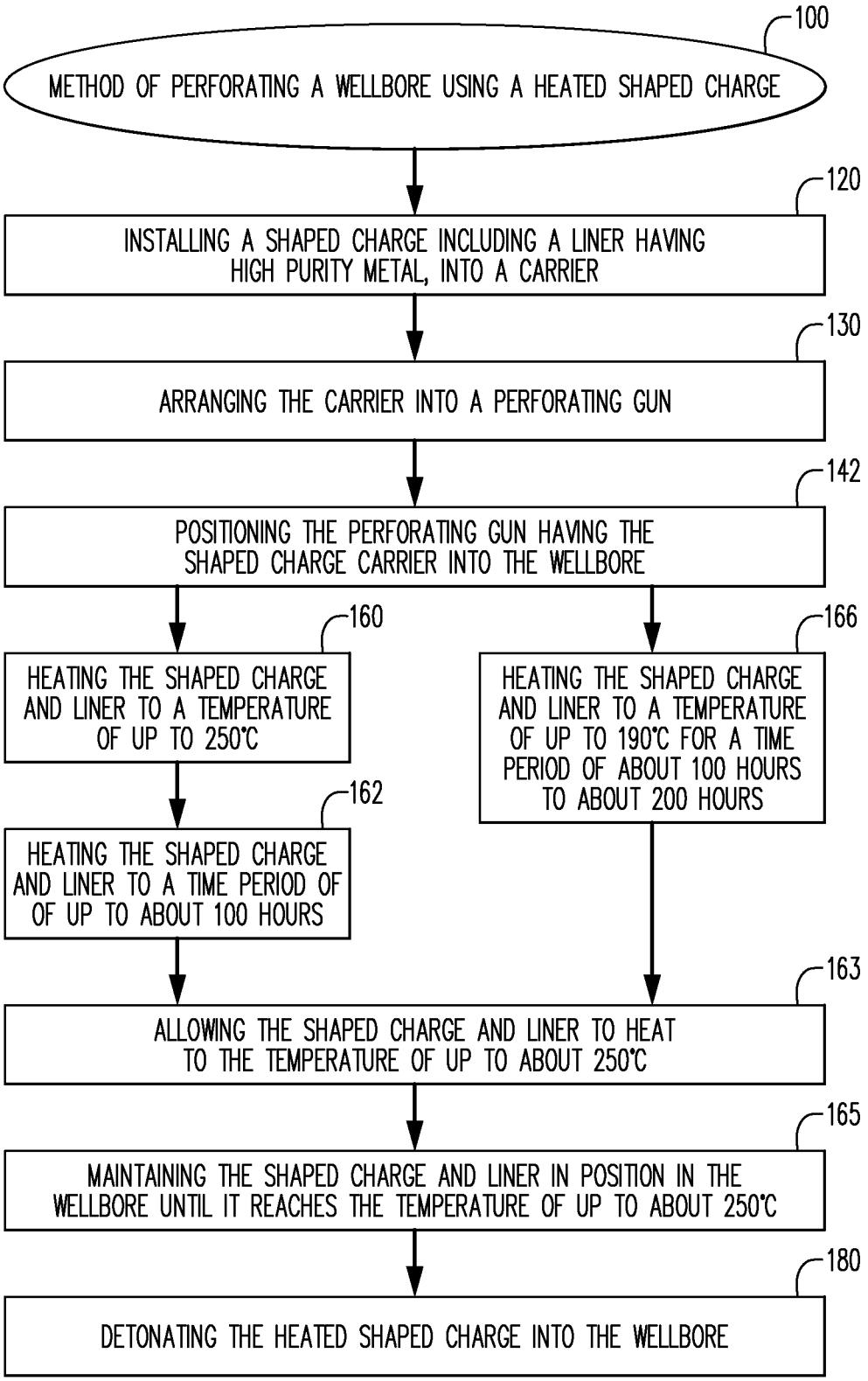
FIG. 7 is a flow chart illustrating a further method of perforating a wellbore using a heated shaped charge, according to an embodiment.

Embodiments further relate to a method of perforating a wellbore using a shaped charge having a shaped charge liner disposed therein, substantially as described hereinabove. As illustrated in the flow charts of FIGS. 6-7, at least one shaped charge is installed 120 into a shaped charge carrier system, and is positioned 140 into the wellbore. Such carrier systems may include a hollow-carrier system having a tube for carrying the shaped charge or an exposed system having a carrier strip upon which the shaped charge is mounted. According to an aspect and as illustrated in FIG. 7, after the shaped charges are positioned into the carrier system, the carrier system is thereafter installed/arranged 130 into a perforating gun system and the perforating gun system including the shaped charge carrier is positioned into the wellbore 142.

The initial ambient temperature of the shaped charge and the shaped charge liner, which is typically the initial ambient temperature at a surface (above ground) of the wellbore, is less than the temperature of the wellbore. Thus, when positioned in the wellbore, the shaped charge and shaped charge liner are both heated from their respective initial ambient temperatures to the wellbore temperature. As illustrated in the flow chart of FIG. 6, the shaped charge is maintained in a position within the wellbore until the shaped charge and liner are heated to a temperature of up to about 250° C. before detonation of the shaped charge. In an embodiment and as depicted in FIG. 7, the shaped charge liner may be heated for a time period of up to about 250 hours when positioned in the wellbore. Alternatively, the shaped charge and liner may be heated to a temperature of about 190° C. for a time period between about 100 hours to about 250 hours, prior to the step of detonating the heated shaped charge. According to aspect, the shaped charge and shaped charge liner are maintained 165 in the wellbore until the shaped charge liner reaches the wellbore temperature.

When heated in the wellbore, the shaped charge liner is thermally softened so that it has a porosity of less than about 20 volume % and maintains its mechanical integrity at a temperature of at least about 250° C. The step of heating 160 the shaped charge and the shaped charge liner modifies the shaped charge liner so its mechanical properties, including ductility, malleability and yield point are improved from the point of high velocity perforation jet formation. For instance, at least one of plurality of metals or the high purity level metal will have a yield point that is 30%, alternatively 15% to 20%, less than that of the equivalent metal at an ambient temperature of about 21° C. In addition, the plurality of metals and/or the high purity level metal has a reduction in hardness of at least about 20%.

Once the shaped charge and shaped charge liner are heated to the desired temperature, the heated shaped charge is detonated 180 into the wellbore, and the liner produces a perforating jet having a detonation velocity of up to about 8,500 meters/second. The liner forms a coherent and rapidly elongating perforating jet, which reduces particulation or separation of the perforation jet upon the detonating 180 of the heated shaped charge into the wellbore.

The present invention may be understood further in view of the following examples, which are not intended to be limiting in any manner. All of the information provided represents approximate values, unless specified otherwise.

EXAMPLE

Various shaped charge liners may be made according to the embodiments of the disclosure. The data presented in the Example shown in Table 1 are based on the theoretical properties of the high purity level metals 14 in the metal powders 12. Such high purity level metals 14 have purity levels of at least about 99.5%. The shaped charge liner may include about 5% of a total weight of its composition, other constituents that may aid in the mixing or combinability of the metal powders and high purity level metal powders.

TABLE 1

| | Temperature (° C.) | Hardness (Vickers (HV)) | Tensile Strength (mega Pascal (MPa)) | Elasticity (giga Pascal (GPa)) |
|---|---|---|---|---|
| Tungsten | Ambient | 410 | 1900-2000 | 380-410 |
| | 250 | 260 | 1600-1620 | 360-370 |
| Molybdenum | Ambient | 260 | 1300-1400 | 310-330 |
| | 250 | 210 | 760-800 | 300-320 |
| Copper | Ambient | 61-66 | 350 | 118-132 |
| | 250 | 46-51 | 250 | 121 |

The high purity level metals 14 presented in Table 1 may include tungsten, molybdenum and/or copper. Table 1 presents the hardness, tensile strength, and modulus of elasticity for tungsten, molybdenum and copper at an ambient temperature of about 21° C./69.8° F. and after each metal is subjected to a temperature of about 250° C./482° F. According to an aspect, the hardness and tensile strength of the tungsten, molybdenum and copper metals decrease when exposed to temperatures up to about 250° C. At 250° C., the elasticity of the tungsten, molybdenum and copper metals also slightly decrease. Without being bound by theory, it is believed that the heating of the high purity level metals of the shaped charge liner 10 reduces of the metals' hardness, tensile strength and modulus of elasticity in a manner that allows the shaped charge liner 10 to maintain its mechanical integrity and enhances the performance of the shaped charge liner 10 when used to perforate steel and rock formations. While several combinations of high purity level metals are contemplated, it has been found that including tungsten and copper, each having a purity level of about 99.5%.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A method of perforating a wellbore using a shaped charge, the method comprising:

installing at least one shaped charge in a shaped charge carrier, wherein the shaped charge comprises a case having a hollow interior, a closed end, and an open end opposite the closed end, an explosive load disposed in the hollow interior, wherein the explosive load is adjacent the closed end, and a shaped charge liner disposed on the explosive load so that the explosive load is positioned between the closed end and the shaped charge liner, wherein a plurality of metal powders are compressed to form the shaped charge liner, the plurality of metal powders including at least one high purity level metal having a purity level of at least about 99.5%, the at least one high purity level metal comprising at least one of copper, tungsten, nickel, titanium, aluminum, lead, tantalum and molybdenum;

positioning the shaped charge carrier comprising the shaped charge into the wellbore;

heating the shaped charge to a temperature of up to about 250° C., so that the shaped charge liner attains a porosity of less than about 20 volume % and maintains its mechanical integrity; and detonating the heated shaped charge into the wellbore.

2. The method of claim 1, wherein:

the wellbore has a wellbore temperature that is greater than an initial ambient temperature of the shaped charge and the shaped charge liner, the initial ambient temperature being the same as a surface temperature above the wellbore; and the shaped charge and shaped charge liner are both heated from their respective initial ambient temperatures to the wellbore temperature while positioned in the wellbore.

3. The method of claim 1, wherein the step of heating the shaped charge and the liner is prior to the step of detonating the heated shaped charge.

4. The method of claim 1, wherein the at least one high purity level metal comprises:

a first high purity level metal having a melting temperature between about 320° C. to about 1200° C.; and a second high purity level metal having a melting temperature between about 1400° C. to about 3500° C., wherein the first high purity level metal comprises about 5% w/w to about 40% w/w of a total weight of the plurality of metal powders, and the second high purity level metal comprises about 60% w/w to about 95% w/w of the total weight of the plurality of metal powders.

5. The method of claim 1, wherein:

the wellbore has a wellbore temperature that is greater than the surface temperature above the wellbore; and the step of heating the shaped charge and the shaped charge liner comprises maintaining the shaped charge and shaped charge liner in the wellbore until the shaped charge liner reaches the wellbore temperature, prior to the step of detonating the shaped charge into the wellbore.

6. A method of perforating a wellbore, the method comprising:

positioning a perforating gun comprising a shaped charge carrier into the wellbore, wherein the shaped charge carrier comprises at least one shaped charge including a case having a hollow interior, a closed end, and an open end opposite the closed end, an explosive load disposed in the hollow interior, wherein the explosive load is adjacent the closed end, and a shaped charge liner disposed on the explosive load so that the explosive load is positioned between the closed end and the shaped charge liner, wherein a plurality of metal powders are compressed to form the shaped charge liner, the plurality of metal powders including at least one high purity level metal having a purity level of at least about 99.5%, the at least one high purity level metal comprising at least one of copper, tungsten, nickel, titanium, aluminum, lead, tantalum and molybdenum;

heating the at least one shaped charge to a temperature of up to about 250° C. so that the shaped charge liner attains a porosity of less than about 20 volume % and maintains its mechanical integrity; and detonating the at least one heated shaped charge in the wellbore.

7. The method of claim 6, wherein the step of heating the at least one shaped charge comprises thermally softening the shaped charge liner, and the step of detonating the at least one heated shaped charge comprises producing at least one perforating jet having a detonation velocity of up to about 8500 meters/second.

8. The method of claim 6, wherein the step of heating the at least one shaped charge includes heating the shaped charge to a temperature from about 190° C. to about 250° C. such that the shaped charge liner is malleable.

9. The method of claim 6, wherein the step of heating the at least one shaped charge modifies the shaped charge liner so that upon detonation of the at least one shaped charge, the shaped charge liner forms a rapidly elongating perforating jet with reduced particulation or separation.

10. The method of claim 6, wherein the step of heating the at least one shaped charge comprises:

heating the at least one shaped charge for a time period of up to about 250 hours, prior to the step of detonating the heated shaped charge.

11. The method of claim 6, wherein the step of heating the at least one shaped charge comprises:

heating the at least one shaped charge to a temperature of up to about 190° C. for a time period between about 100 hours to about 250 hours, prior to the step of detonating the at least one heated shaped charge.

12. The method of claim 6, wherein the at least one high purity level metal has a melting temperature of at least 320° C.

13. A method of perforating a wellbore, the method comprising:

positioning a perforating gun into the wellbore, wherein the perforating gun comprises at least one shaped charge including a case having a hollow interior, a closed end, and an open end opposite the closed end, an explosive load disposed in the hollow interior, wherein the explosive load is adjacent the closed end, and a shaped charge liner disposed on the explosive load so that the explosive load is positioned between the closed end and the shaped charge liner, wherein a plurality of metal powders are compressed to form the shaped charge liner, the plurality of metal powders including at least one high purity level metal having a purity level of at least about 99.5% and being present in an amount up to about 95% w/w of a total weight of the plurality of metal powders, the at least one high purity level metal comprising at least one of copper, tungsten, nickel, titanium, aluminum, lead, tantalum and molybdenum;

heating the at least one shaped charge to a temperature of up to about 250° C. so that the shaped charge liner attains a porosity of less than about 20 volume % and maintains its mechanical integrity; and detonating the at least one heated shaped charge in the wellbore.

14. The method of claim 13, wherein the step of heating the at least one shaped charge comprises thermally softening the shaped charge liner, and the step of detonating the at least one heated shaped charge comprises producing at least one perforating jet having a detonation velocity of up to about 8500 meters/second.

15. The method of claim 13, wherein the step of heating the at least one shaped charge includes heating the shaped charge to a temperature from about 190° C. to about 250° C., such that the shaped charge liner is malleable.

16. The method of claim 13, wherein the step of heating the at least one shaped charge modifies the shaped charge liner so that upon detonation of the at least one shaped charge, the shaped charge liner forms a rapidly elongating perforating jet with reduced particulation or separation.

17. The method of claim 13, wherein the step of heating the at least one shaped charge comprises:

heating the at least one shaped charge for a time period of up to about 250 hours, prior to the step of detonating the heated shaped charge.

18. The method of claim 13, wherein the step of heating the at least one shaped charge comprises:

heating the at least one shaped charge to a temperature of up to about 190° C. for a time period between about 100 hours to about 250 hours, prior to the step of detonating the at least one heated shaped charge.

19. The method of claim 13, wherein the at least one high purity level metal has a melting temperature of at least 320° C.

* * * * *